US005286909A

United States Patent [19]

Shibukawa

[11] Patent Number: 5,286,909

[45] Date of Patent: Feb. 15, 1994

[54] KEY-TO-BE-DEPRESSED DESIGNATING AND COMPARING APPARATUS USING A VISUAL DISPLAY

[75] Inventor: Takeo Shibukawa, Hamamatsu, Japan

[73] Assignee: Yamaha Corporation, Hamamatsu, Japan

[21] Appl. No.: 841,419

[22] Filed: Feb. 26, 1992

[30] Foreign Application Priority Data

Mar. 1, 1991 [JP] Japan ..... 3-036422

[51] Int. Cl.[5] ..... G10H 7/00; G04B 13/00; A63H 5/00

[52] U.S. Cl. ..... 84/609; 84/612; 84/478

[58] Field of Search ..... 84/462, 470 R, 477 R, 84/478, 609-612, 634, 636

[56] References Cited

U.S. PATENT DOCUMENTS

| | | | |
|---|---|---|---|
| 4,364,299 | 12/1982 | Nakada et al. | 84/477 R X |
| 4,437,378 | 3/1984 | Ishida et al. | 84/478 X |
| 4,651,612 | 3/1987 | Matsumoto | 84/478 X |
| 4,694,723 | 9/1987 | Shinohara et al. | 84/478 X |
| 4,703,681 | 11/1987 | Okamoto | 84/478 |
| 4,915,005 | 4/1990 | Shaffer et al. | 84/464 A X |
| 5,069,104 | 12/1991 | Shibukawa | 84/478 |

*Primary Examiner*—William M. Shoop, Jr.
*Assistant Examiner*—Jeffrey W. Donels
*Attorney, Agent, or Firm*—Spensley Horn Jubas & Lubitz

[57] ABSTRACT

A key-to-be-depressed designating apparatus, employed in a keyboard-type electronic musical instrument, is suitable particularly for novice keyboard-instrument players, and this apparatus is designed to automatically and sequentially designate the keys to be depressed in accordance with the predetermined tune. This apparatus includes a read-only memory (ROM) which prestores automatic performance data, a central processing unit (CPU) and a plurality of guide lamps. These guide lamps are disposed along with the keys of keyboard, so that they are sequentially turned on and off so as to designate a key to be depressed in accordance with the automatic performance data read from the ROM under control of the CPU. If the designated key is actually depressed by the performer within the predetermined period of time concerning its correct key-depression timing, key-to-be-depressed designating operation made by the guide lamps is continued. If not, such key-to-be-depressed designating operation is terminated. Thus, even if the novice player makes mis-touches and delay of key-depression in the keyboard-performance practice, the performance of the tune can be smoothly progressed.

19 Claims, 18 Drawing Sheets

FIG.3 (MEMORY MAP FOR SONG DATA)

FIG.4 (MAIN ROUTINE)

FIG.5 (AUTOMATIC PERFORMANCE PROCESS ROUTINE -part I-)

FIG.6 (AUTOMATIC PERFORMANCE PROCESS ROUTINE -part II-)

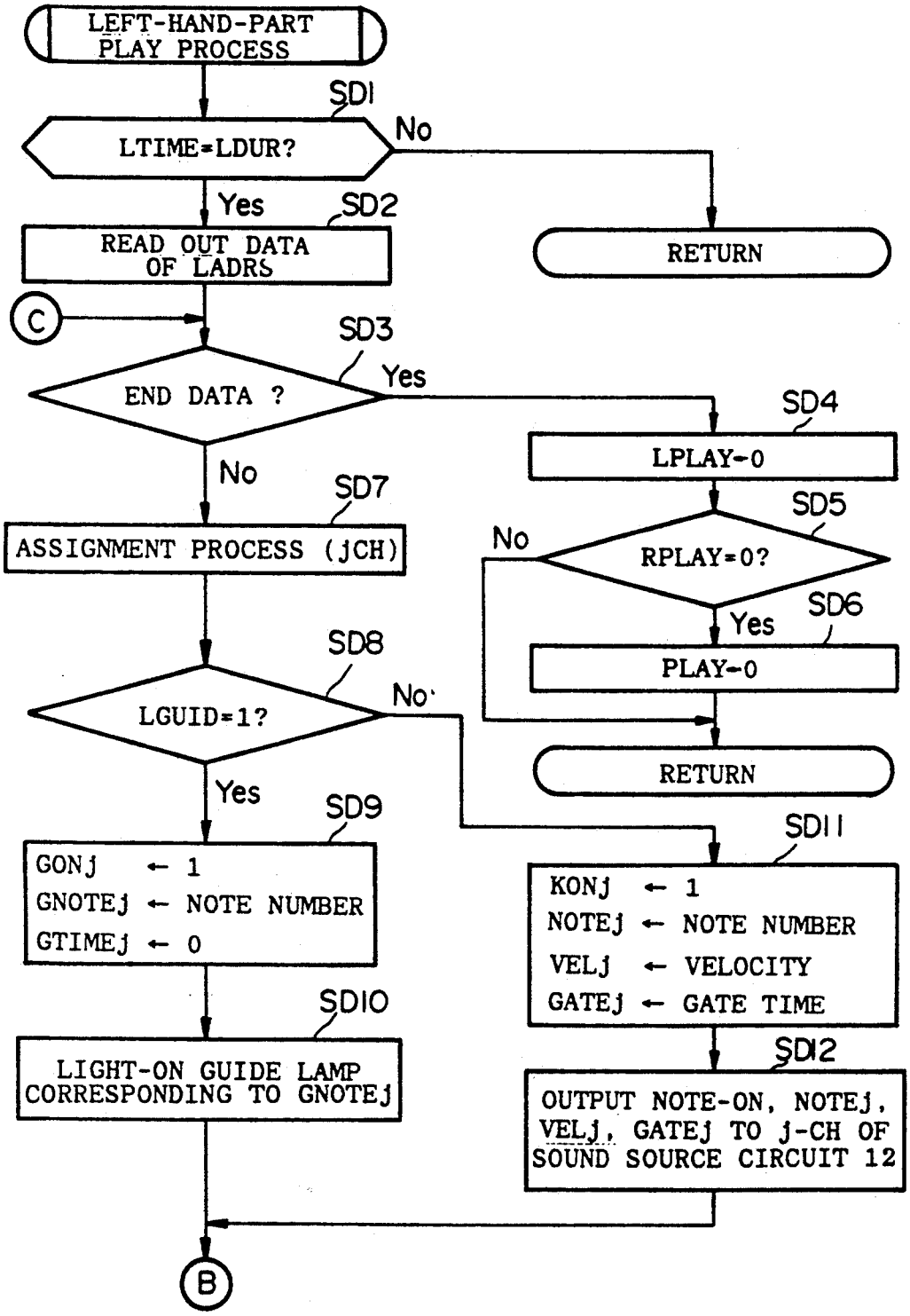
FIG.8 (LEFT-HAND-PART PLAY PROCESS ROUTINE -part I-)

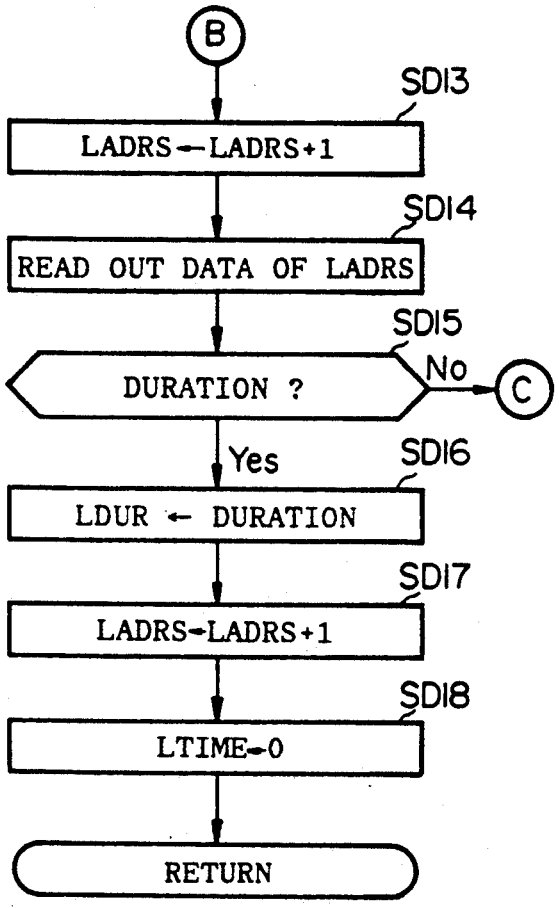
FIG.9 (LEFT-HAND-PART PLAY PROCESS ROUTINE -part II-)

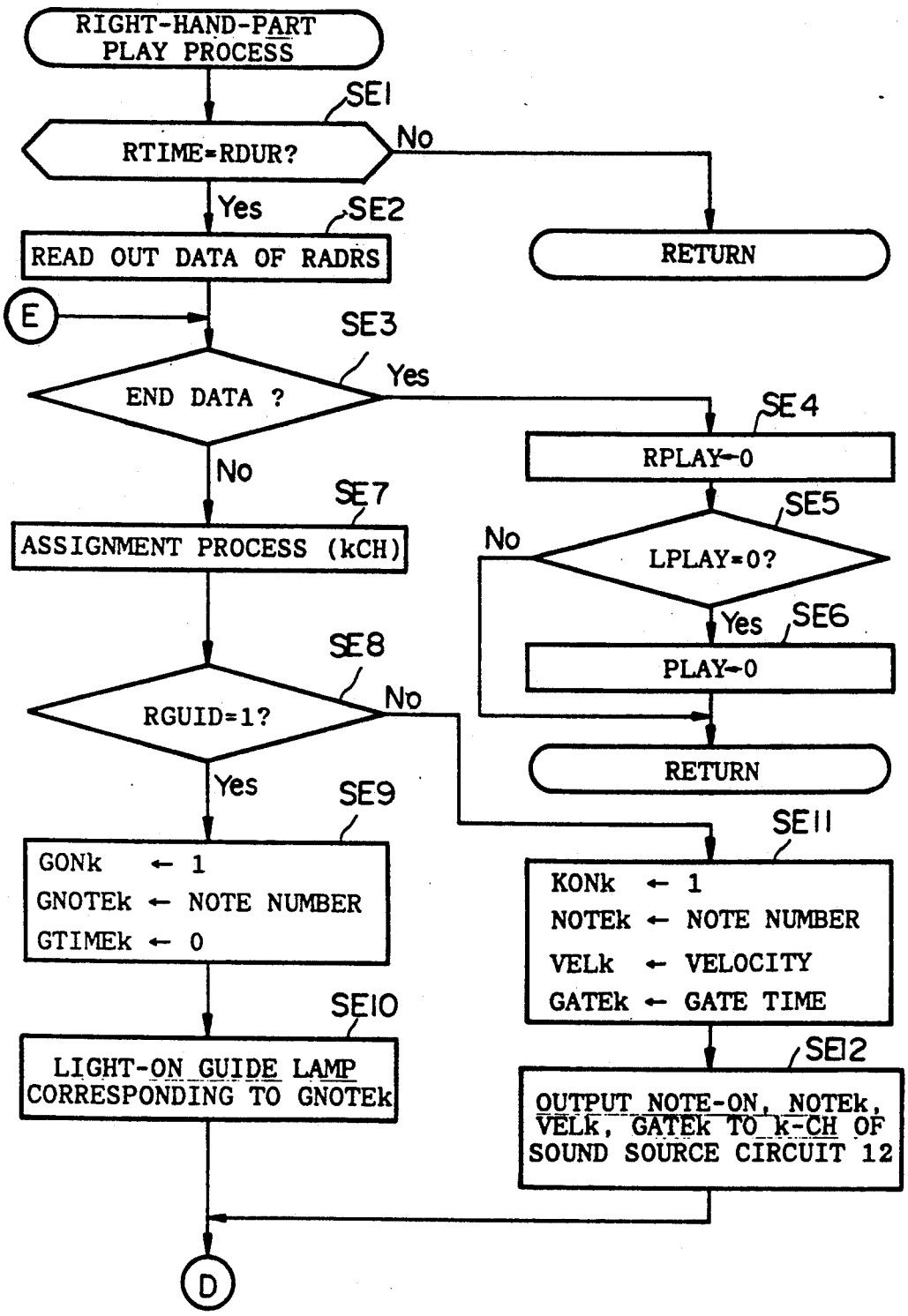
FIG.10 (RIGHT-HAND-PART PLAY PROCESS ROUTINE -part I-)

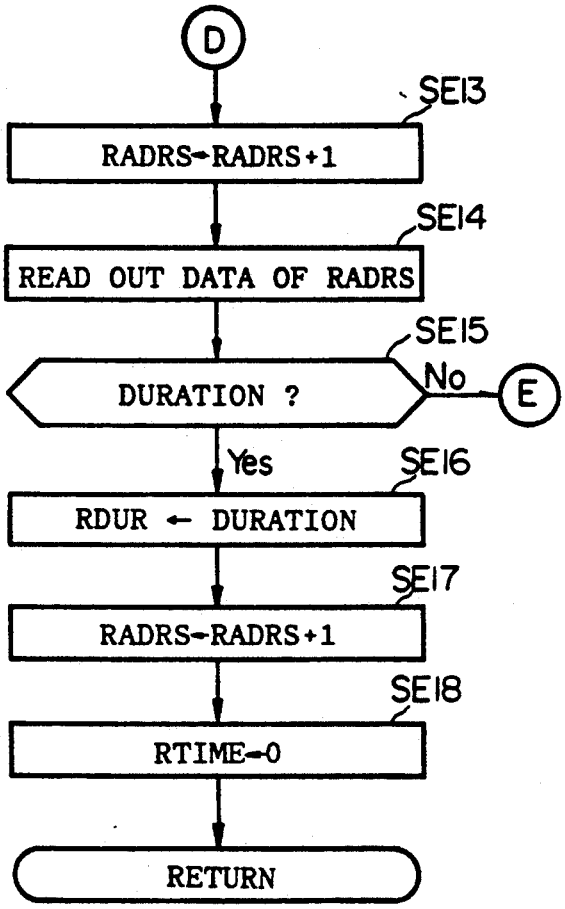
FIG.11 (RIGHT-HAND-PART PLAY PROCESS ROUTINE -part II-)

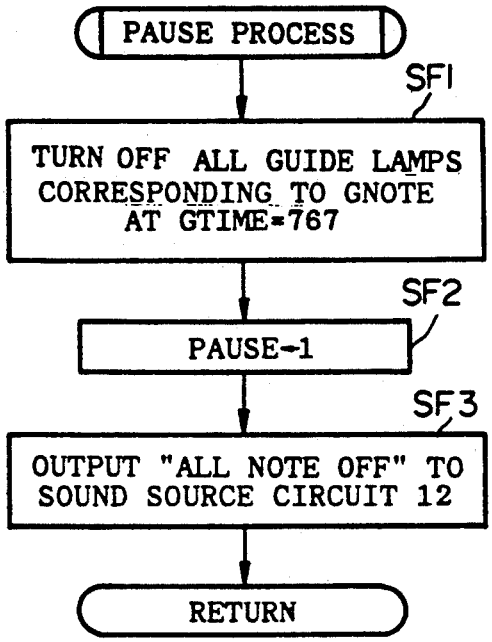
FIG. 12 (PAUSE PROCESS ROUTINE)

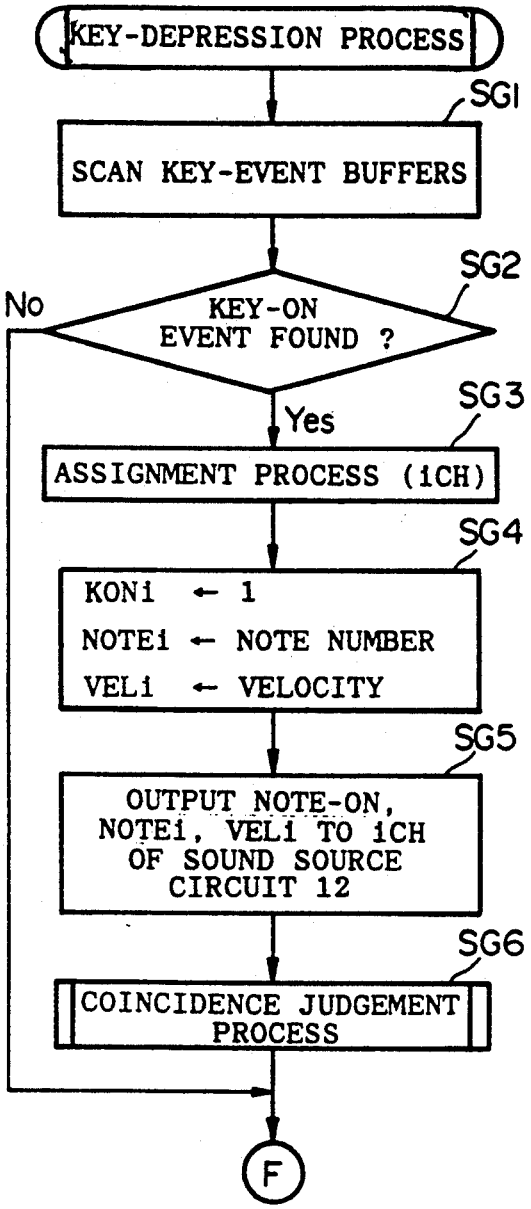
FIG.13 (KEY-DEPRESSION PROCESS ROUTINE -part I-)

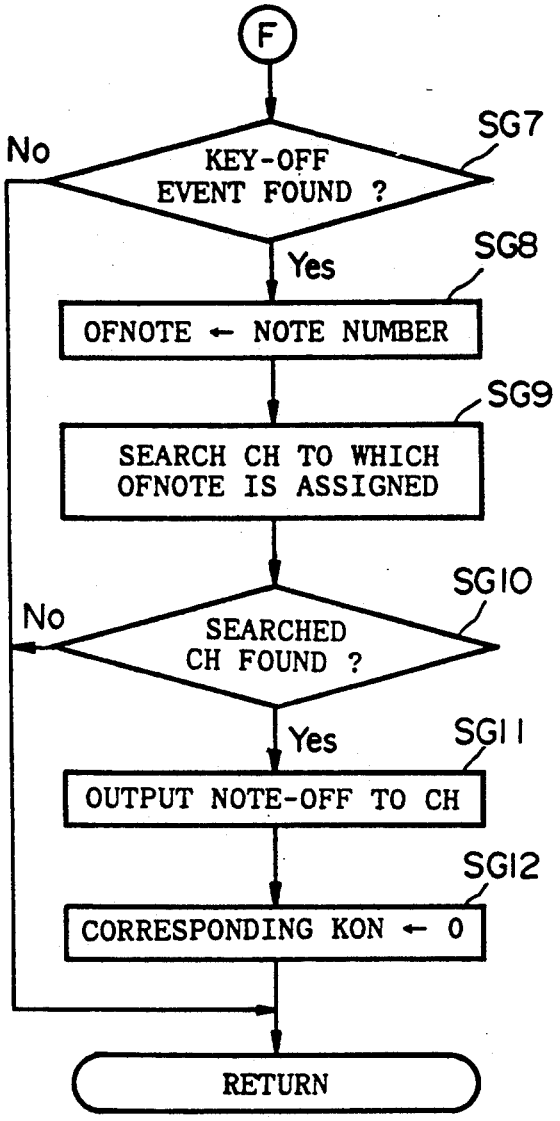
FIG.14 (KEY-DEPRESSION PROCESS ROUTINE -part II-)

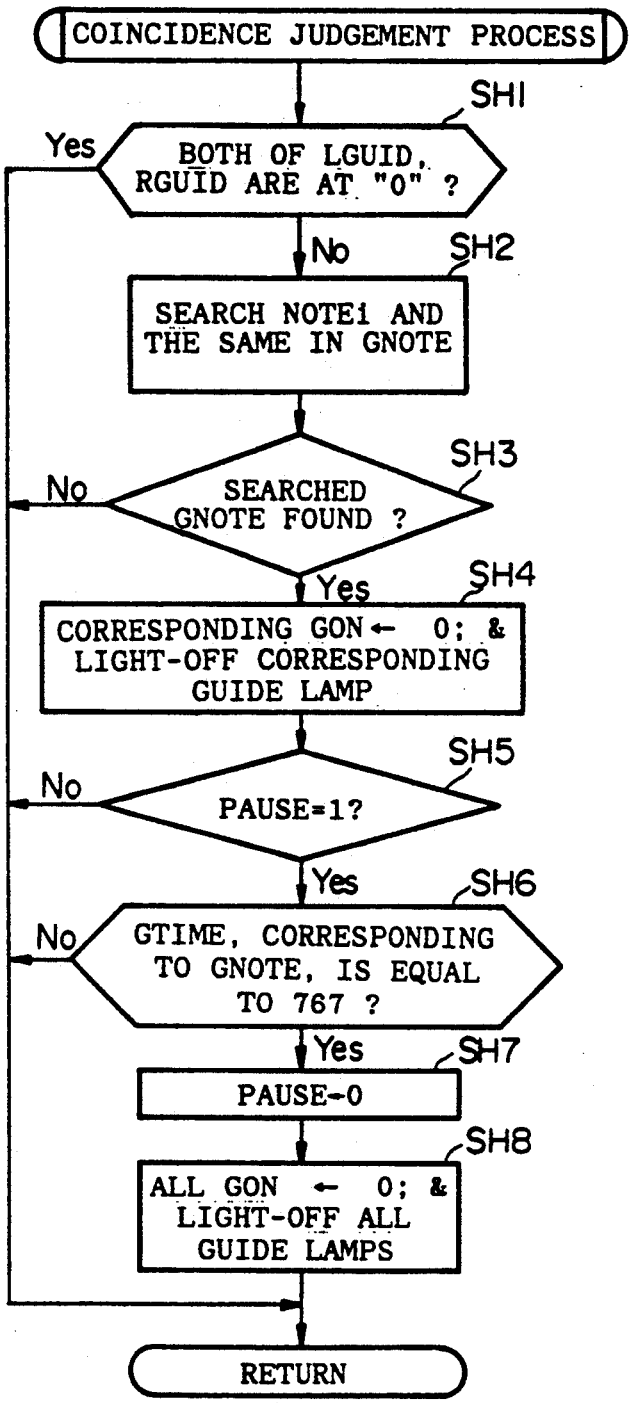
FIG.15 (COINCIDENCE JUDGEMENT PROCESS ROUTINE)

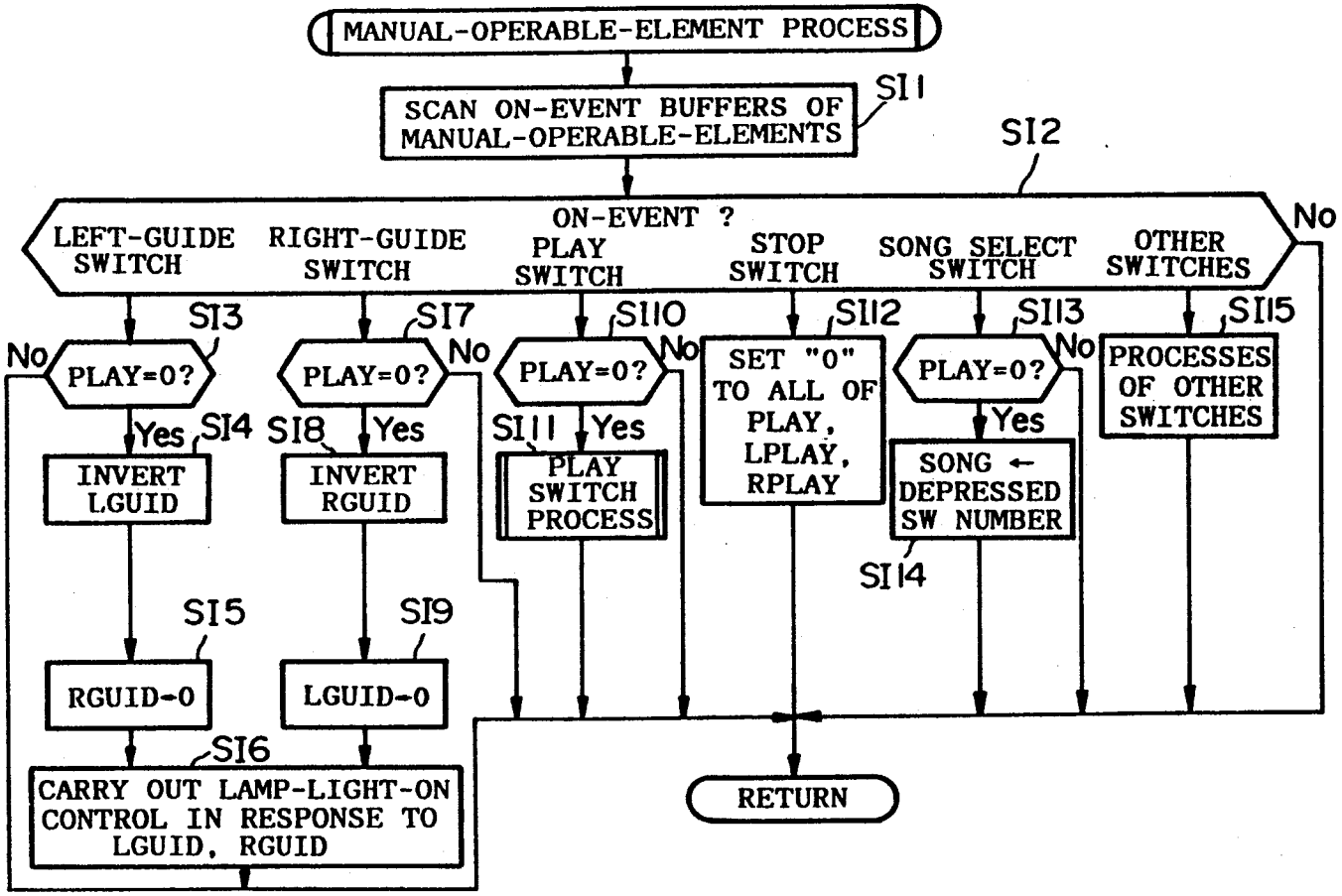
FIG. 16 (MANUAL-OPERABLE-ELEMENT PROCESS ROUTINE)

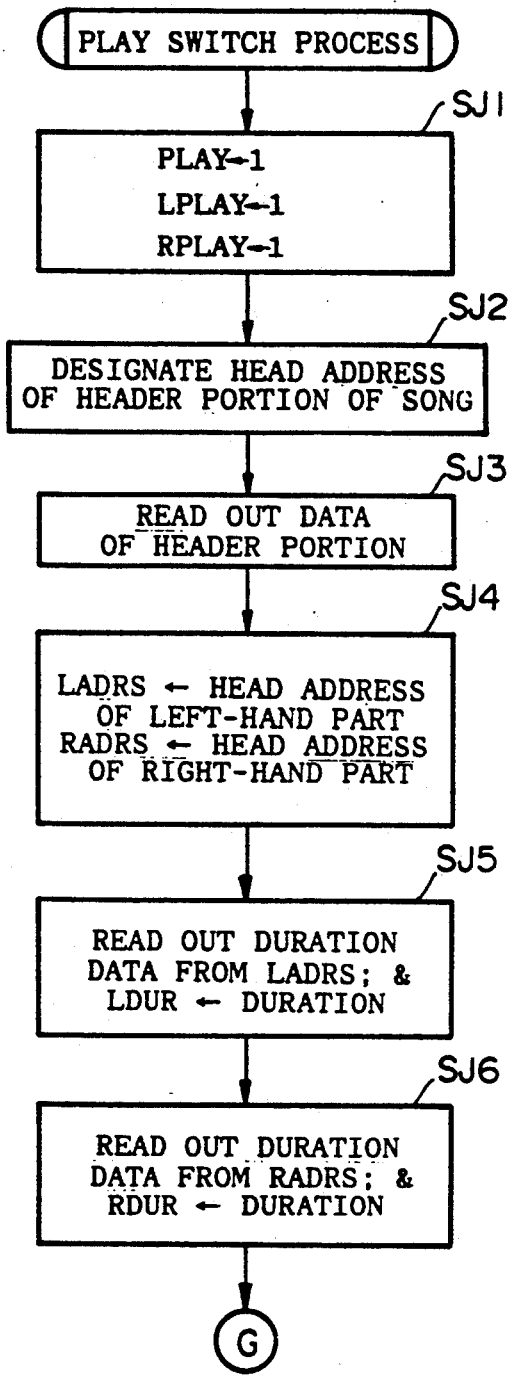
FIG.17 (PLAY SWITCH PROCESS ROUTINE -part I-)

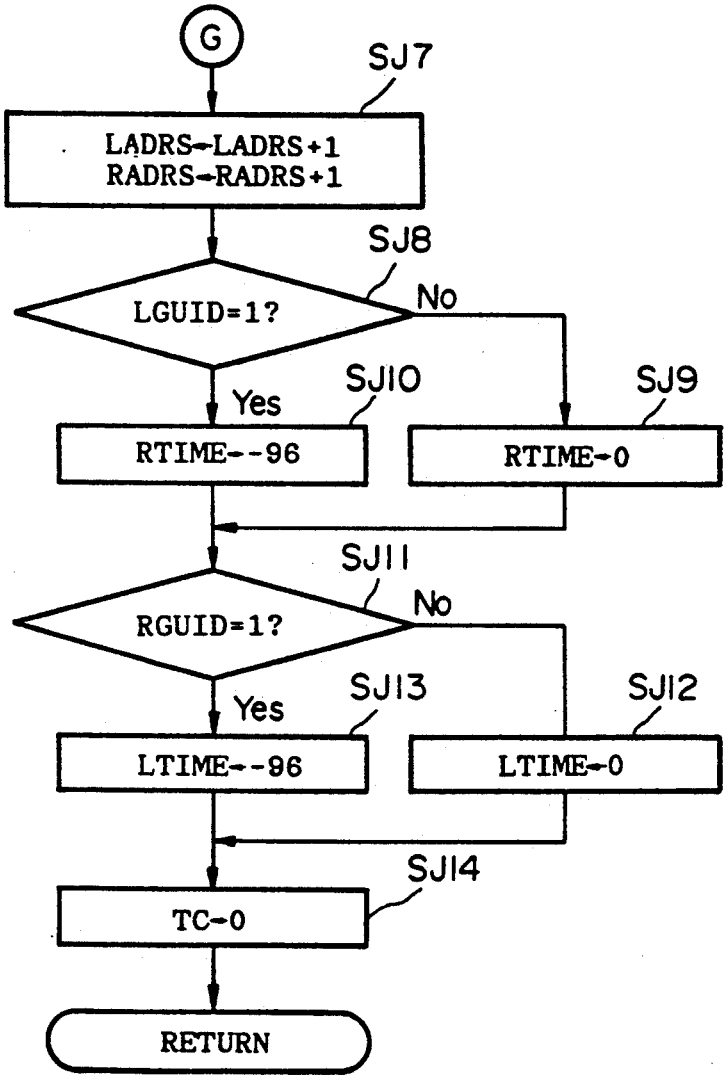
FIG.18 (PLAY SWITCH PROCESS ROUTINE -part II-)

KEY-TO-BE-DEPRESSED DESIGNATING AND COMPARING APPARATUS USING A VISUAL DISPLAY

BACKGROUND OF THE INVENTION

1. Field of the Invention

The present invention relates to a key-to-be-depressed designating apparatus which is suitable when being used for the performance practice of a keyboard-type electronic musical instrument and the like.

2. Prior Art

In one conventional key-to-be-depressed designating apparatus, the performer can practice the performance by depressing keys which are sequentially designated by the small lamps (e.g., LEDs) sequentially lighted on in accordance with the progress of a tune to be performed. However, when the performer does not depress the designated key, the conventional apparatus immediately stops the light-on operation of the lamps at that key-depression timing and waits for the correct key-depression to be made by the performer.

Such kind of key-to-be-depressed designating techniques are specifically described in Japanese Patent Laid-Open Publication No. 2-189572, entitled "Automatic Key-Depression Designating Apparatus".

To beginners, even if the performance practice is made by use of the keyboard-type electronic musical instrument having the key-to-be-depressed designating apparatus, errors caused by the mis-touch (i.e., key-touch event in which wrong keys are depressed by mistake) or delay of key-depression should occur frequently.

In the conventional key-to-be-depressed designating apparatus, every time the mis-touch or delay of key-depression occurs, light-on operation of the key-to-be-depressed designating lamps is stopped, which avoids the smooth progress of the tune to be performed.

In addition, the above-mentioned drawback sometimes affects the performance practice.

SUMMARY OF THE INVENTION

It is accordingly a primary object of the present invention to provide a key-to-be-depressed designating apparatus in which even if beginners make the performance practice full of the mis-touches or delays of key-depression, the performed tune can progress smoothly.

In one embodiment of the present invention, there is provided a key-to-be-depressed designating apparatus, which is employed in a keyboard-type electronic musical instrument having plural keys, comprising:

a memory means for storing automatic performance data corresponding to an automatic performance;

a read-out means for performing a read-out operation so as to read out the automatic performance data from the memory means;

a designating means for sequentially designating a key to be depressed among plural keys in accordance with automatic performance data; and a control means for controlling the read-out means such that the read-out operation is continued when the designated key is depressed within the predetermined period of time concerning its correct key-depression timing, while the read-out operation is terminated when the designated key is not depressed within the predetermined period of time.

According to one embodiment of the present invention, when the performer depresses the key designated by the designating means within a predetermined period of time, the control means controls the read-out means to continue its read-out operation such that the automatic performance data is continuously read from the memory means. Therefore, even if there is a small delay in key-depression, the performed tune can progress smoothly.

However, if the performer does not depress the key within the predetermined period of time, the control means stops the read-out operation of the read-out means. In this case, the performer is informed that a substantial delay in key-depression has occured or that a correct key has not been depressed.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings:

FIGS. 8, 9 are flowcharts showing a left-hand-part play process routine;

FIGS. 10, 11 are flowcharts showing a right-hand-part play process routine;

FIG. 12 is a flowchart showing a pause process routine;

FIGS. 13, 14 are flowcharts showing a key-depression process routine;

FIG. 15 is a flowchart showing a coincidence judgement process routine;

FIG. 16 is a flowchart showing a manual-operable-element process routine; and FIGS. 17, 18 are flowcharts showing a play switch process routine.

DESCRIPTION OF A THE PREFERRED EMBODIMENT

[A] Configuration of Embodiment

Figure 1:
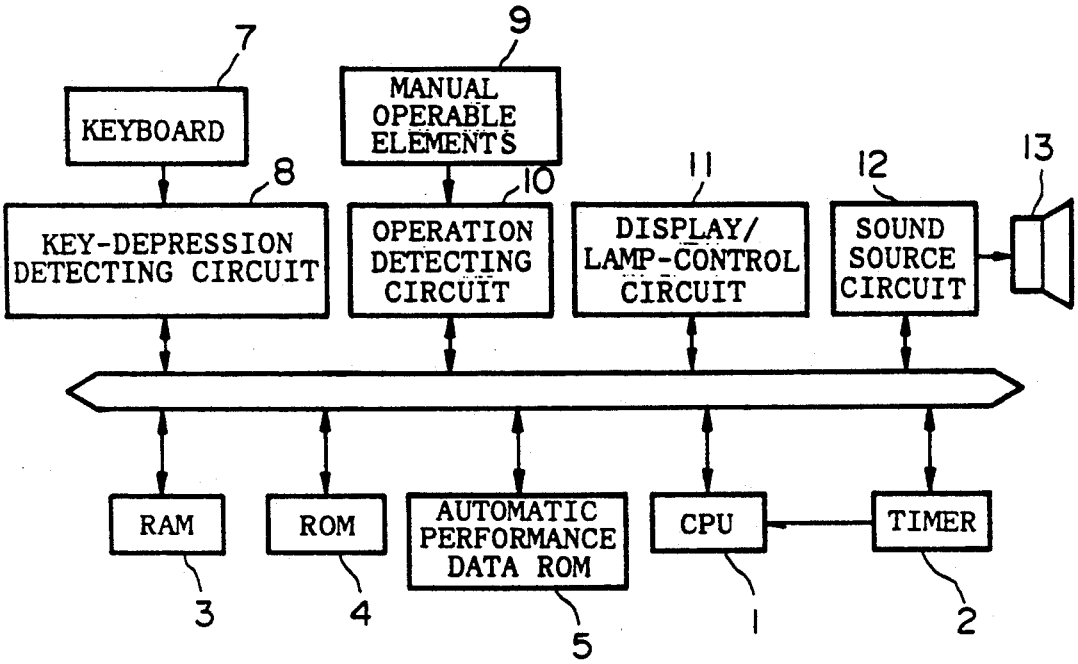
FIG. 1 is a circuit block diagram showing an electronic musical instrument providing the key-to-be-depressed designating apparatus according to one embodiment of the present invention.
Figure 2:
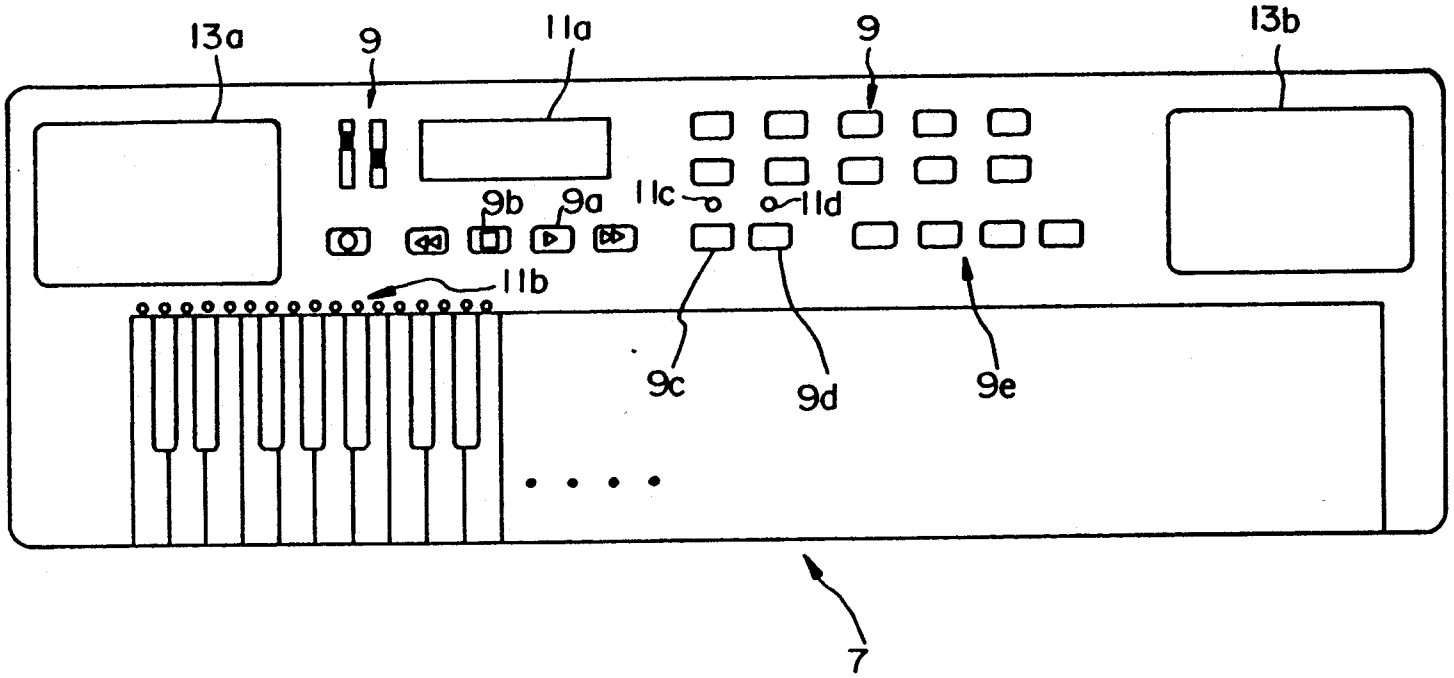
FIG. 2 is a front view illustrating an outside appearance of the key-to-be-depressed designating apparatus according to one embodiment of the present invention.

Now, description will be given with respect to a preferred embodiment of the present invention with references to the drawings. FIG. 1 is a block diagram showing an electric configuration of a keyboard-type electronic musical instrument providing a key-to-be-depressed designating apparatus according to an embodiment of the present invention, and FIG. 2 is the front of one embodiment of the present key-to-be-depressed designating apparatus. In these drawings, 1 indicates a central processing unit (i.e., CPU) which controls operations of the other portions, and 2 indicates a timer. Each time the time designated by time-count data set by the CPU 1 is passed, this timer 2 outputs a timer interrupt pulse to the CPU 1. In addition, 3 indicates a random access memory (i.e., RAM) which stores several kinds of registers, flags, key-event buffers, which are used when the CPU 1 performs its processes, and several kinds of on-event buffers of manual-operable switches and controls. Further, 4 indicates a read-only memory (i.e., ROM) which stores control programs used by the CPU 1, and 5 indicates an automatic performance data ROM which stores the automatic performance data.

Figure 3:
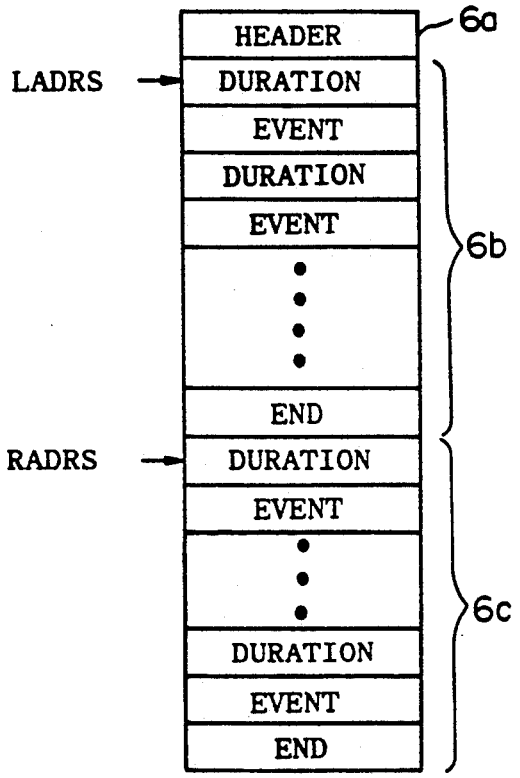
FIG. 3 shows an example of the memory map storing the automatic performance data.

FIG. 3 illustrates one example of the data format of song data, i.e., automatic performance data. Herein, 6*a* indicates a data area corresponding to the header portion which stores data representing the tempo of an automatic performance, number of bars (or measures), tone colors etc.; 6*b* indicates a data area which stores data for left-hand parts; and 6*c* indicates a data area which stores data for right-hand parts. Each data area 6*b* and 6*c* stores event data representing key-on, note number, velocity, etc., as well as duration data representing the time interval between two events and end data representing the end of data area. The song data, including the above-mentioned data areas 6*a* to 6*c*, is stored in the automatic performance data ROM 5.

Figure 7:
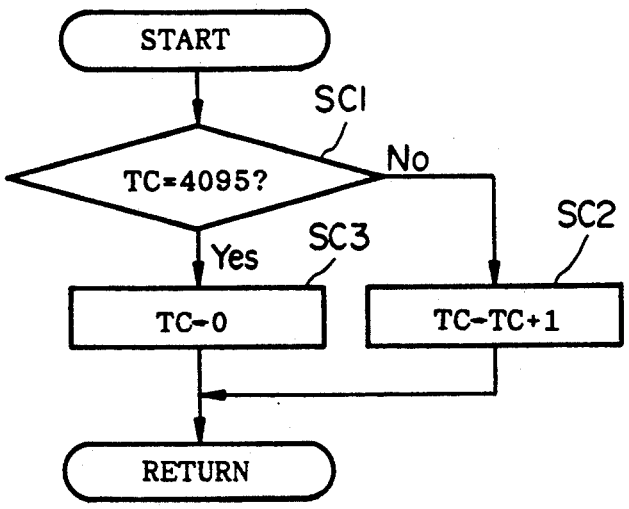
FIG. 7 is a flowchart showing a tempo clock process routine.

In the embodiment illustrated in FIGS. 1 and 2, 7 indicates a keyboard including plural keys; 8 indicates a key-depression detecting circuit which detects key-depression made on the keyboard 7, and then outputs corresponding key information; and 9 indicates several kinds of manually-operable switches and controls (i.e., manually-operable elements). The manually-operable switches 9 include a play switch 9*a*, a stop switch 9*b*, a left-guide switch 9*c*, a right-guide switch 9*d* and plural song select switches 9*e*. The function of each switch will be described hereinafter. In addition, 10 indicates an operation detecting circuit which detects the operation of each switch 9, and then outputs operation information corresponding to the operated switch.

Further, 11 indicates a display/lamp-control circuit which manages a display portion 11*a*, which may be crystal liquid display, guide lamps 11*b* and other lamps 11*c* and 11*d*.

According to one embodiment of the present invention, these lamps are configured by LEDs, the guide lamps 11*b* are disposed at the predetermined positions located just above each of the keys of the keyboard 7. Lamps 11*c* and 11*d* are respectively positioned just above the left-guide switch 9*c* and right-guide switch 9*d*. Furthermore, 12 indicates a sound source circuit which outputs a musical tone signal under control of the CPU 1, and 13 indicates a sound system configured by an amplifier, speakers 13*a*, 13*b*, etc. which generates musical tones corresponding to the musical tone signals.

[B] Operation of Embodiment

The operations of the CPU 1 according to one embodiment of the present invention will be described hereafter with reference to FIGS. 4–18.

Figure 4:
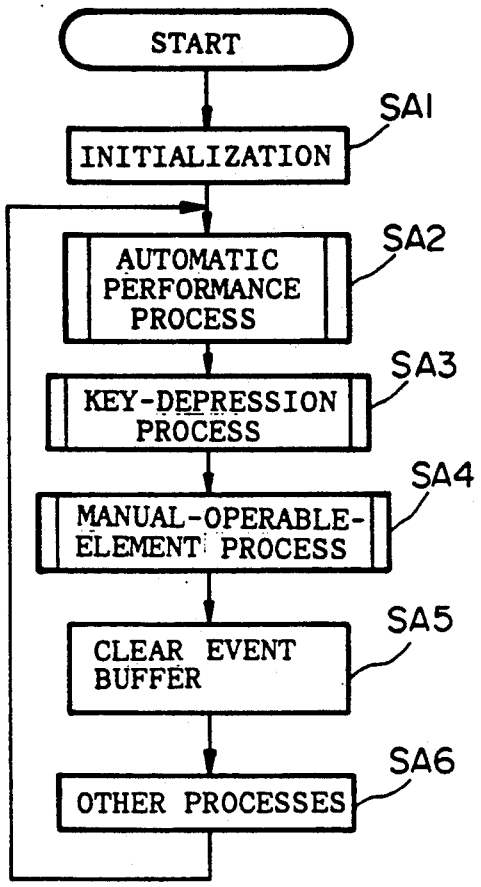
FIG. 4 is a flowchart showing a main routine of the embodiment.

When the power is on in the electronic musical instrument, the processing of the CPU 1 proceeds to step SA1 in a main routine shown in FIG. 4, wherein several portions are initialized. During the initialization, an initial tone color is set in the sound source circuit 12, and registers of the RAM 3 are all cleared, for example. Then, the processing of the CPU 1 proceeds to next step SA2.

In step SA2, automatic performance processing is carried out.

Figure 5:
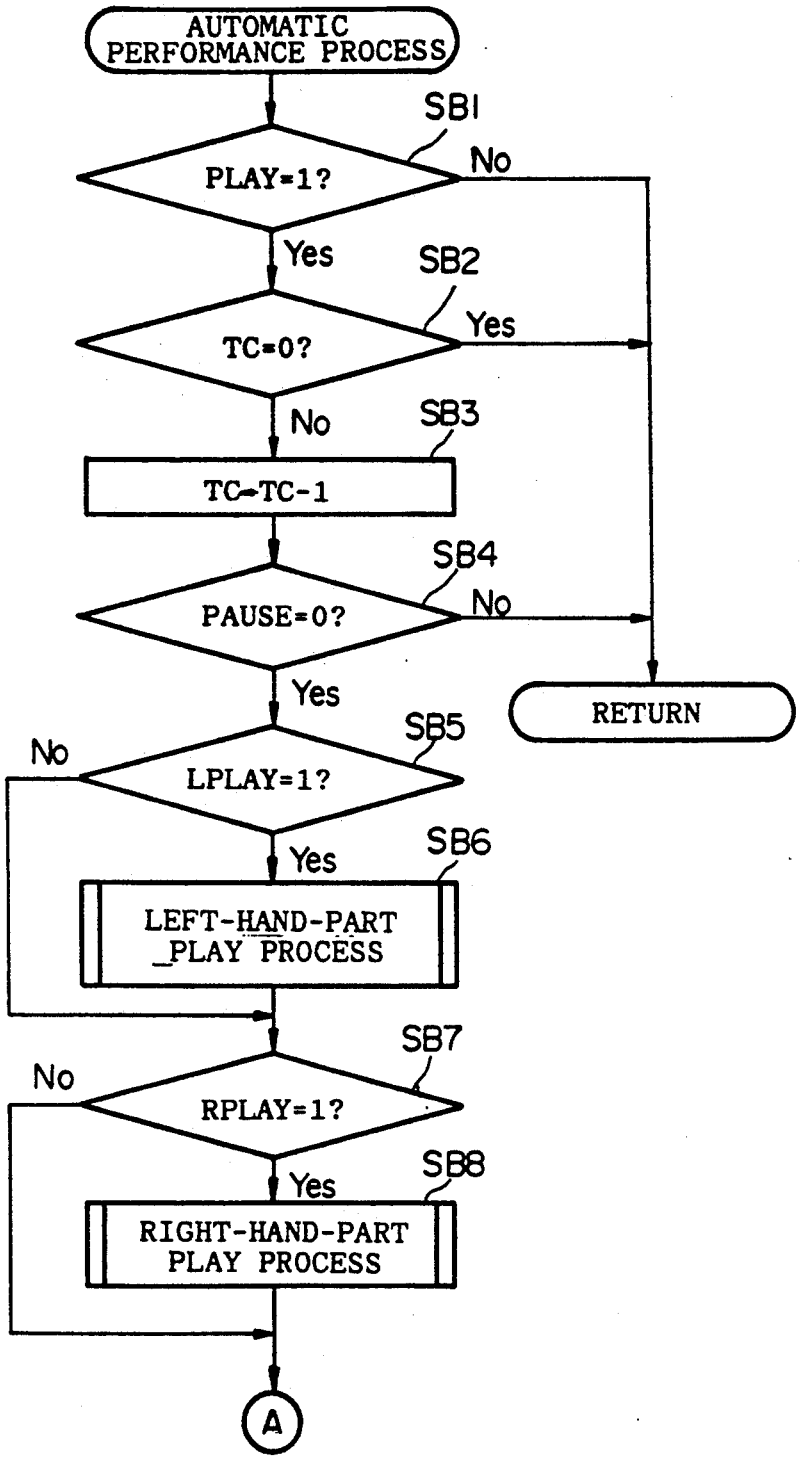
FIGS. 5, 6 are a flowchart showing an automatic performance process routine.
Figure 6:
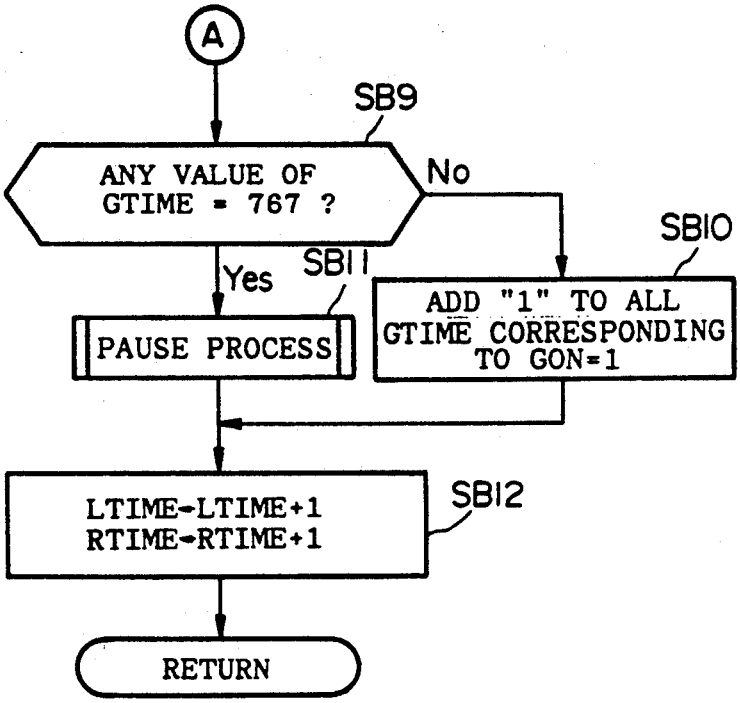

As illustrated, for example, in FIGS. 5 and 6, the processing first proceeds to step SB1 wherein it is judged whether or not a play flag PLAY is set at "1". The flag PLAY is set at "1" when the performer depresses the play switch 9*a*, while it is set at "0" when the performer depresses the stop switch 9*b*. However, due to the manually operable-element process routine which will be described later in detail (see FIG. 16), this flag PLAY may have been already set at "1" or "0". When it is set at "1" in advance, even if the performer depresses the play switch 9*a*, it is not changed and remains at "1". If it is set at "0", then to "1" by depressing the play switch 9*a*. Now, when the judgement result of step SB1 is "NO", indicating that the flag PLAY is set at "0", the processing, then to the main routine shown in FIG. 4, and proceeds to step SA3.

On the other hand, if the judgement result of step SB1 is "YES", indicating that the flag PLAY is set at "1", when the processing proceeds to step SB2.

In step SB2, it is judged whether or not value of a register TC which stores tempo clocks is equal to "0". A tempo clock-according to one embodiment of the present invention will be described hereafter. The tempo clock corresponds to the value which is incremented by the timer interrupt process to be made responsive to the tempo in every constant period. FIG. 7 shows a routine of tempo clock process. In first step SC1 of this routine, it is judged whether or not value of the register TC is equal to "4095". If the judgement result is "NO", the processing proceeds to step SC2.

In step SC2, value of the register TC is incremented by "1", and then the processing returns to the main routine shown in FIG. 4.

On the other hand, if the judgement result of step SC1 is "YES", indicating that value of the register TC is equal to "4095", the processing proceeds to step SC3.

In step SC3, value of the register TC is reset at "0", and then the processing returns to the main routine.

Next, description will be given back to the routine of automatic performance process as shown in FIGS. 3 and 6. If the judgement result of step SB2 shown in FIG. 5 is "YES", indicating that value of the register TC is equal to "0", then the processing returns back to the main routine, wherein it proceeds to step SA3.

On the other hand, if the judgement result of step SB2 is "NO", indicating that value of the register TC is not equal to "0", the processing proceeds to step SB3.

In step SB3, value of the register TC is decremented by "1". Now, detailed description will be given with respect to the above-mentioned processes of steps SB2, SB3. According to one embodiment of the present invention the time interval between the timer interrupt processes is set to be different than the operation period of the main routine. Thus processes of the main routine can be carried out once with respect to one cycle of the timer interrupt process.

Now, consideration will be given with respect to the case where the main routine process may be carried out several times within the time interval between two timer interrupt processes sequentially made. In this case, value of the register TC is incremented to "1" by the first timer interrupt process, for example. In the first automatic performance process of the main routine after the first timer interrupt process, the judgement result of step SB2 turns to "NO", so that value of the register TC is decremented by "1" in step SB3. Then, processes of steps SB4 etc. will be carried out.

In next automatic performance process, value of the register TC has been set at "0" by the previous decrementing process of step SB3. Therefore, in the next automatic performance process, the judgement result of step SB2 turns to "YES", therefore, other processes of steps SB3 etc. in the automatic performance process are not carried out.

Then, until the next timer interrupt process is carried out, those processes of steps SB3 etc. are not carried out. As a result, the automatic performance process of the main routine is carried out once with respect to one timer interrupt process. Thereafter, the processing proceeds to step SB4.

In step SB4, it is judged whether or not a pause flag PAUSE is reset at "0". The flag PAUSE is set at "1" by the pause process routine (see FIG. 12) in the case where the performer does not depress the designated key within two-measure period of time after the correct key-depression position is designated by the guide lamp 11*b* in the left-hand-part play process routine (see FIGS. 8, 9) or right-hand-part play process routine (see FIGS. 10, 11). If the performer does not depress the designated key within the above-mentioned predetermined period of time. Then the flag PAUSE is set at "1". Therefore, the judgement result of step SB4 turns to "NO", so that other processes of the automatic performance process are neglected. Thus, the processing returns back to the main routine, wherein it proceeds to step SA3.

In contrast, if the performer depresses the designated key within the predetermined period of time, or if the performer depresses the key relating to the temporary stop operation (or pause operation) of the automatic performance process in the pause process routine (see FIG. 12), the flag PAUSE is reset at "0". Thus, the judgement result of step SB4 turns to "YES", so that the processing proceeds to step SB5.

In step SB5, it is judged whether or not a left play flag LPLAY is set at "1". The flag LPLAY relates to the left-hand-part performance. Therefore, flag LPLAY is simultaneously set at "1" at a time when the flag PLAY is set at "1" in the manual-operable-element process routine (see FIG. 16). Then, it is reset at "0" when the performer depresses the stop switch 9*b* shown in FIG. 2, or when the left-hand-part performance is completed. If the judgement result of step SB5 is "YES", indicating that the flag LPLAY is set at "1", the processing proceeds to step SB6.

In step SB6, the key-depression positions are guided by the left-hand-part guide lamps 11*b*, or the left-hand-part play process routine is carried out so as to generate the musical tones. FIGS. 8 and 9 illustrate such a routine in accordance with one embodiment of the present invention. In step SD1 shown in FIG. 8, it is judged whether or not value of a register LTIME, indicating the tone-generation timings of the left-hand-part play, is equal to value of another register LDUR. The duration data, which is stored in the area corresponding to the head address LADR (see FIG. 3) for the left-hand part of the song data designated by the performer in the manually-operable-element process routine (see FIG. 16), is read out and then stored in the above-mentioned register LDUR in the play switch process routine (see FIGS. 17, 18). If the judgement result of step SD1 is "NO", i.e., the value of the register LTIME is not equal to that of the register LDUR, indicating that it is not the tone-generation timing for the left-hand-part play, then the processing returns to the foregoing automatic performance process routine shown in FIGS. 5, 6, and wherein it proceeds to step SB7.

On the other hand, if the judgement result of step SD1 is "YES", i.e., the value of the register LTIME is equal to that of the register LDUR, indicating that it is the tone-generation timing for the left-hand-part play, then the processing proceeds to step SD2.

In step SD2, the event data is read out from the address area of the song data corresponding to the value of the register LADRS (see FIG. 3). After the duration data is read out from the address area of the song data corresponding to the value of the register LADRS in the play switch process routine (see FIGS. 17, 18), the value of the register LADRS is incremented by "1". Therefore, at this time, the event data corresponding to the read duration data must be stored in the address area of the song data corresponding to the incremented value of the register LADRS. For this reason, the above-mentioned read-out process of step SD2 can be carried out. Thereafter, the processing proceeds to step SD3.

In step SD3, it is judged whether or not the read data is the end data. If the judgement result of step SD3 is "YES", the processing proceeds to step SD4 in order to terminate the left-hand-part performance.

In step SD4, the flag LPLAY is reset at "0". Thereafter, the processing proceeds to step SD5.

In step SD5, it is judged whether or not a right play flag RPLAY is reset at "0". This flag RPLAY relates to the right-hand-part performance. As similar to the foregoing left play flag LPLAY, this flag RPLAY is simultaneously set at "1" at the same time when the flag PLAY is set at "1" in the manual-operable-element process routine (see FIG. 16), while this flag RPLAY is reset at "0" when the performer depresses the stop switch 9*b* shown in FIG. 2 or when the right-hand-part performance is completed. If the judgement result of step SD5 is "NO", indicating that the right play flag RPLAY is at "1", the then processing returns to the automatic performance process routine shown in FIGS. 5, and 6, wherein it proceeds to step SB7.

On the other hand, if the judgement result of step SD5 is "YES", indicating that the right play flag RPLAY is reset at "0", the then processing process to step SD6.

In step SD6, the flag PLAY is reset at "0", thereafter, the processing returns to the automatic performance process routine shown in FIGS. 5 and 6, wherein it proceeds to step SB7.

Meanwhile, if the judgement result of the foregoing step SD3 is "NO", indicating that the data read in step SD2 is not the end data but the key-on data, then the processing proceeds to step SD7 in order to carry out the key-depression designating operation for left-hand part or its tone-generation operation.

In step SD7, the CPU 1 carries out the channel assignment process. Herein, an idle channel (e.g., j-channel, indicated as "jCH") in which the tone-generation process is not made is located within the plural channels of the sound source circuit 12, and then, the musical tone corresponding to the key-on data which is read out in step SD2 is assigned to the idle channel jCH. Then, the processing proceeds to step SD8.

In step SD8, it is judged whether or not a left-hand-part guide flag LGUID is set at "1". The value of flag LGUID is inverted when the performer depresses the left guide switch 9*c* under the state where the flag PLAY is reset at "0". Thus, until the flag LGUID is set at "1" after the performer depresses the left guide switch 9c under the state where the flag PLAY is reset at "0", the guide process using the left-hand-part guide lamps 11b will not be carried out.

If the performer depresses the left guide switch 9c under the state where the flag PLAY is reset at "0" and the flag LGUID is set at "1", the judgement result of step SD8 turns to "YES", and consequently, the processing of the CPU 1 proceeds to step SD9.

In step SD9, the guide lamp is turned on for the key, assigned to jCH, to be depressed, and a guide-on flag GONj representing such light-on event is set at "1". Then, the note number which is read out by the process of step SD2 is stored in a guide note number register GNOTEj in which the note number corresponding to the depressing key assigned to jCH is to be stored. A guide time register GTIMEj is used when measuring the passing time which is passed from the correct key-depression timing for the depressing key assigned to jCH. Therefore, value of this register GTIMEj is reset at "0". Then, the processing proceeds to step SD10.

In step SD10, the guide lamp 11b (see FIG. 2) corresponding to the register GNOTEj is turned on, and thereafter, the processing proceeds to step SD13 shown in FIG. 9.

On the other hand, if the judgement result of step SD8 is "NO", indicating that the flag LGUID is reset at "0", the processing branches to step SD11 in order to carry out the tone-generation process.

In step SD11, key-on flag KONj indicating that jCH is in the on-state is set at "1". In addition, the note number which is read out in the process of SD2 is stored in a register NOTEj in which note number of jCH is to be stored; the velocity which is read out by the process of SD2 is stored in a register VELj in which velocity of jCH is to be stored; and the gate time which is read out by the process of step SD2 is stored in a register GATEj in which gate time of jCH is to be stored. Thereafter, the processing proceeds to step SD12.

In step SD12, note-on data and the other data stored in the registers NOTEj, VELj, GATEj are outputted to jCH of the sound source circuit 12. Then, the processing proceeds to step SD13 shown in FIG. 9.

In step SD13, value of the register LADRS is incremented by "1". Then, the processing proceeds to step SD14.

In step SD14, the CPU 1 reads out the data stored in the address area of the song data corresponding to the incremented value of the register LADRS. Then, the processing proceeds to step SD15.

In step SD15, it is judged whether or not the data to be read out by the previous process of step SD14 is the duration data. If the judgement result is "NO", the processing returns to the foregoing step SD3 shown in FIG. 8. This judgement result turns to "NO" when two or more sounds are simultaneously generated at one timing.

On the other hand, if the judgement result of step SD15 is "YES", indicating that the data to be read out by the process of step SD14 is the duration data, the processing proceeds to step SD16.

In step SD16, the read duration data is stored in the register LDUR. Then, the processing proceeds to step SD17.

In step SD17, value of the register LADRS is incremented by "1". Then, the processing proceeds to step SD18.

In step SD18, value of the register LTIME is reset at "0". Thereafter, the processing returns to the foregoing automatic performance process routine (see FIGS. 5, 6), wherein it proceeds to step SB7.

By carrying out all of the above-mentioned processes toward the end data of the song data, it is possible to carry out the left-hand-part guide process or its tone-generation process.

Next, description will be given back with respect to the automatic performance process routine as shown in FIGS. 5, 6. In the case where the judgement result of step SB5 shown in FIG. 5 is "NO", indicating that the flag LPLAY is reset at "0", the processing proceeds to step SB7.

In step SB7, it is judged whether or not the flag RPLAY, which is described before in the left-hand-part play process routine (see FIGS. 8, 9), is set at "1". If the judgement result of this step SB7 is "YES", indicating that the flag RPLAY is set at "1", the then processing proceeds to step SB8.

In step SB8, the right-hand-part play process is carried out, so that the key-depression positions are guided by the right-hand-part guide lamps 11b or its tone-generation process is made. FIGS. 10 and 11 illustrate such a routine in accordance with one embodiment of the present invention. Since all of the processes of this routine shown in FIGS. 10, 11 are identical to those shown in FIGS. 8, 9, detailed description thereof will be omitted. After carrying out the processes of the right-hand-part play process routine of step SB8, the processing proceeds to step SB9 shown in FIG. 6.

On the other hand, even if the judgement result of step SB7 is "NO", indicating that the flag RPLAY is reset at "0", the processing also proceeds to step SB9.

In the above-mentioned processes of steps SB5 to SB8, processes of the left-hand-part play and right-hand-part play are respectively carried out by use of the flags LPLAY, RPLAY. This is because there may be a difference between the end timings of the left-hand-part and right-hand-part performances. Therefore, by resetting the flag LPLAY or RPLAY at "0", the performance of the corresponding part is ended so that its performance processes are ended. If both parts are ended, as described before, the flag PLAY is reset at "0" in the left-hand-part play routine (see FIGS. 8, 9) or right-hand-part play process routine (see FIGS. 10, 11).

In step SB9 shown in FIG. 6, it is judged whether or not any one of plural registers GTIME stores the value equal to "767". In the present embodiment, number of clocks in one quarter-note period is set at "96". Therefore, the timing corresponding to "767" clocks indicates that the time corresponding to eight quarter-notes, i.e., two measures has been passed after any one of the registers GTIME is reset at "0" (so that its corresponding guide lamp 11b is turned on) in the left-hand-part play process routine or right-hand-part play routine. Incidentally, the guide lamp 11 is turned on prior to its correct key-depression timing by one-quarter-note (i.e., one-beat) period of time. For this reason, the event in which value of the register GTIME becomes equal to "767" indicates that the time corresponding to one measure and three beats has been passed after the correct key-depression timing of the key to be depressed by the performer. When the judgement result of this step SB9 is "NO", indicating that the value of the register GTIME is not equal to "767", the processing proceeds to step SB10.

In step SB10, all of the values of the registers GTIME each having the flag GON at "1" are incremented by "1". Then, the processing proceeds to step SB12.

On the other hand, if the judgement result of step SB9 is "YES", indicating that value of the register GTIME is equal to "767", the then processing proceeds to step SB11.

In step SB11, the temporary stop operation (i.e., pause process) is carried out in the automatic performance process, one embodiment of such a routine is shown in FIG. 12. In first step SF1 of this pause process routine, the CPU 1 turns off all of the guide lamps 11*b* corresponding to the note numbers stored in all of the registers GNOTE each having the value "767". Then, the processing proceeds to step SF2.

In step SF2, the flag PAUSE is set at "1", wherein this flag PAUSE has been already described in step SB4 of the foregoing automatic performance process routine (see FIGS. 5, 6). Then, the processing proceeds to step SF3.

In step SF3, all-note-off data is outputted to the sound source circuit 12 so as to terminate generation of all of the musical tones which are now generating. Then, the processing returns to the automatic performance process routine, wherein it proceeds to step SB12 shown in FIG. 6.

In the foregoing left-hand-part play process routine (see FIGS. 8, 9) and right-hand-part play process routine (see FIGS. 10, 11), the registers LTIME, RTIME store the respective tone-generation timings for the left-hand and right-hand parts in order to compare them to each other. In step SB12, values of these registers LTIME, RTIME are both incremented by "1". Then, the processing returns back to the main routine shown in FIG. 4, wherein it proceeds to step SA3.

In this step SA3 shown in FIG. 4, the CPU 1 executes the key-depression process which is activated when any key in the keyboard 7 is depressed or released. The contents of this routine in accordance with one embodiment of the present invention is shown in FIGS. 13 and 14. In first step SG1 shown in FIG. 13, the CPU 1 scans the key-event buffers provided in the RAM 3. The key-event buffer is designed to store the key event which occurs during one execution of the main routine. After completing this process of step SG1, the processing of the CPU 1 proceeds to step SG2.

In step SG2, it is judged whether or not the on-event has occurred. If the judgement result of this step SG2 is "NO", the then processing branches to step SG7 shown in FIG. 14.

On the other hand, if the judgement result is "YES", indicating that the on-event is occurred, then the processing proceeds to step SG3.

In step SG3, the CPU 1 carries out the channel assignment process. More specifically, the CPU 1 searches for idle channels (represented by "iCH") in which the tone-generation process is not carried out within plural channels of the sound source circuit 12, and then the musical tone of the key to be currently depressed is assigned to an idle channel. Thereafter, the processing proceeds to step SG4.

In step SG4, a key-on flag KONi, indicating that iCH is on, is set at "1"; note number of the depressed key is stored in a register NOTEi which is provided to store the note number of iCH; and velocity data of the depressed key is stored in a register VELi which is provided to store the velocity data of iCH. Then, the processing proceeds to step SG5.

In step SG5, the note-on data, and the data respectively stored in the registers NOTEi, VELi are outputted to the sound source circuit 12. Then, the processing proceeds to step SG6.

In step SG6, the CPU 1 executes the coincidence judgement process in which it is judged whether or not the key depressed by the performer coincides with the correct key designated by the guide lamp 11*b*. FIG. 15 shows the contents of such a routine in accordance with one embodiment of the present invention. In first step SH1 of this routine, it is judged whether or not both of the flags LGUID, RGUID are reset at "0". As described before, each of these flags LGUID, RGUID is set at "1" when the key-depression guiding process is made by the left-hand-part or right-hand-part guide lamps 11*b*. Therefore, when the judgement result of step SH1 is "YES", indicating that both of the flags LGUID, RGUID are not set at "1", it can be judged that the above-mentioned guiding process is not operating. In this case, the coincidence judgement process is not carried out. Thus, the processing returns to the key-depression process routine as shown in FIGS. 13 and 14, wherein it proceeds to step SG7 shown in FIG. 14.

On the other hand, if the judgement result of step SH1 is "NO", indicating that either one of the flags LGUID, RGUID is set at "1", the then guiding process is carried out, so that the processing proceeds to next step SH2.

In step SH2, the CPU 1 searches the register GNOTE, of which note number is identical to that of the register NOTEi, within plural registers GNOTE corresponding to the flag GON at "1". In other words, the CPU 1 for the key identical to the currently depressed key within plural keys to be depressed. Then, the processing proceeds to step SH3.

In step SH3, it is judged whether or not the CPU 1 finds out the register GNOTE, searched in the foregoing step SH2, within plural registers GNOTE. If the judgement result is "NO", indicating that there is no register GNOTE, searched in step SH2, within plural registers GNOTE, the processing returns to the key-depression process routine shown in FIGS. 13 and 14, wherein it proceeds to step SG7 shown in FIG. 14.

On the other hand, if the judgement result of step SH3 is "YES", indicating that there is existed the register GNOTE, searched in step SH2, within plural registers GNOTE, the processing proceeds to step SH4.

In step SH4, value "0" is set to the guide-on flag GON corresponding to the note number stored in the register GNOTE which further corresponds to the key to be depressed by the performer. In addition, the CPU 1 turns off the guide lamp 11*b* corresponding to the above register GNOTE, and then the processing thereof proceeds to step SH5.

In step SH5, it is judged whether or not the flag PAUSE is set at "1". In other words, it is judged whether or not the pause process has been already carried out. If the judgement result is "NO", indicating that the flag PAUSE is reset at "0" so that the pause process is not made, then the processing returns to the key-depression process routine, and proceeds to step SG7 shown in FIG. 14.

On the other hand, if the judgement result of step SH5 is "YES", indicating that the flag PAUSE is set at "1" so that the pause process will be made, the processing proceeds to step SH6.

In step SH6, it is judged whether or not the value "767" is set to the flag GTIME corresponding to the note number stored in the register GNOTE which further corresponds to the key to be depressed by the performer. In other words, it is judged whether or not the depressed key cause the pause process to be carried out. If the judgement result is "NO", indicating that the value of the above-mentioned flag GTIME is not equal to "767" so that the depressed key does not concern the pause process, then the processing returns to the key-depression process routine, wherein it proceeds to step SG7 shown in FIG. 14.

On the other hand, if the judgement result of step SH6 is "YES", indicating that the value of the above-mentioned flag GTIME is equal to "767" so that the depressed key is the key concerning the pause process (of which guide lamp 11*b* is turned off), then the processing proceeds to step SH7.

In step SH7, the flag PAUSE is reset at "0" so that the pause process of the automatic performance is released. Then, the processing proceeds to step SH8.

In step SH8, all of the guide-on flags GON are reset at "0" and all of the guide lamps 11*b* are turned off. Therefore, after re-starting the automatic performance process from that time on, the processing returns to the key-depression process routine, wherein it proceeds to step SG7 shown in FIG. 14.

In step SG7, it is judged whether or not the key-off event is occurred. If the judgement result is "NO", indicating that no key-off event is occurred, then the processing returns back to the main routine shown in FIG. 4, wherein it proceeds to step SA4.

On the other hand, if the judgement result of step SG7 is "YES", indicating that the key-off event has occurred, the processing proceeds to step SG8.

In step SG8, note number of the key of which key-off event is occurred is stored in a register OFNOTE of which value represents the key-off note number. Then, the processing proceeds to step SG9.

In step SG9, the CPU 1 searches the channel "CH" of the sound source circuit 12 to which the key corresponding to the note number stored in the register OFNOTE is assigned. Then, the processing proceeds to step SG10.

In step SG10, it is judged whether or not the CPU 1 can find out the above-mentioned channel "CH" in the sound source circuit 12. If the judgement result is "YES", the processing proceeds to step SG11.

In step SG11, the note-off data is supplied to the channel CH in the sound source circuit 12. Then, the processing proceeds to step SG12.

In step SG12, the flag KON corresponding to the searched note number is reset at "0". Then, the processing returns back to the main routine shown in FIG. 4, wherein it proceeds to step SA4.

On the other hand, if the judgement result of step SG10 is "NO", indicating that there is no channel CH to be existed in the sound source circuit 12, the processing returns back to the main routine shown in FIG. 4, wherein it proceeds to step SA4. Such judgement result can be obtained under the state where the musical tones have been already muted by the known truncate process, for example.

In step SA4 shown in FIG. 4, the manually-operable-element processes are carried out when any one of the switches and controls (i.e., manually-operable elements) 9 is operated. FIG. 16 shows the contents of this routine in accordance with one embodiment of the present invention. In step SI1 of this routine, the CPU 1 scans several kinds of on-event buffers for the manually-operable elements 9 which are set in the RAM 3. Such manually-operable-element on-event buffers stores the on-event of any one of the manually-operable elements which has occurred during one execution period of the main routine. Then, the processing of the CPU 1 proceeds to step SI2.

In step SI2, it is judged whether or not there occurs an on-event in the manually-operable elements 9. If the judgement result of this step SI2 is "NO", then the processing returns back to the main routine shown in FIG. 4, wherein it proceeds to step SA5.

On the other hand, if the judgement result of this step SI2 is "YES", indicating that the on-event has occurred in any one of the switches 9, the processing proceeds to the corresponding one of steps SI3, SI17, SI10, SI12, SI13, SI15 in accordance with the operated switch. First, when the left-guide switch 9*c* shown in FIG. 2 is depressed on, the processing branches to step SI3.

In step SI3, it is judged whether or not the foregoing flag PLAY is reset at "0". If the judgement result is "NO", indicating that the flag PLAY is set at "1", then the processing returns back to the main routine shown in FIG. 4, wherein it proceeds to step SA5. This prevents the present system from responding to the operation of the left-guide switch 9*c* during the automatic performance.

On the other hand, if the judgement result of step SI3 is "YES", indicating that the flag PLAY is reset at "0", then the processing proceeds to step SI4.

In step SI4, the CPU 2 inverts the state of the left-hand-part guide flag LGUID which is described in the foregoing left-hand-part play process routine (see FIGS. 8, 9). More specifically, the flag LGUID is reset to "0" when it is set at "1", while the flag LGUID is set to "1" when it is reset at "0". In the initial state, this flag LGUID is set at "0", therefore, the value thereof will be changed from "0" to "1". Then, the processing proceeds to step SI5.

In step SI5, the right-hand-part guide flag RGUID, which is described in the foregoing right-hand-part play process routine (see FIGS. 10, 11), is set at "0". Then, the processing proceeds to step SI6.

In step SI6, in response to the states of the flags LGUID, RGUID, the lamp 11*c* or 11*d* shown in FIG. 2 is turned on under control of the CPU 1. Thereafter, the processing returns back to the main routine shown in FIG. 4, wherein it proceeds to step SA5.

On the other hand, if the judgement result of step SI2 is "YES" with respect to the right guide switch 9*d* shown in FIG. 2 which is depressed on, the processing branches to step SI7.

In step SI7, it is judged whether or not the flag PLAY is reset at "0". If the judgement result is "NO", indicating that the flag PLAY is set at "1", then the processing returns back to the main routine, wherein it proceeds to step SA5. This prevents the present system from responding to the operation of the right guide switch 9*d* during the automatic performance.

On the other hand, if the judgement result of step SI7 is "YES", indicating that the flag PLAY is reset at "0", then the processing proceeds to step SI8.

In step SI8, the CPU 1 inverts the state of the right-hand-part guide flag RGUID. More specifically, the flag RGUID is reset to "0" when it is set at "1", while the flag RGUID is set to "1" when it is reset at "0". In the initial state, this flag RGUID is set at "0". Therefore, value of this flag RGUID is changed from "0" to "1". Then, the processing proceeds to step SI9.

In step SI9, the left-hand-part guide flag LGUID is set at "0". Then, the processing proceeds to the foregoing step SI6.

Meanwhile, if the judgement result of step SI2 is "YES" with respect to the play switch 9a shown in FIG. 2, the processing branches to step SI10.

In step SI10, it is judged whether or not the flag PLAY is reset at "0". If the judgement result is "NO", indicating that the flag PLAY is set at "1", the processing returns back to the main routine, wherein it proceeds to step SA5. This prevents the present system from responding to the operation of the play switch 9a during the automatic performance.

On the other hand, if the judgement result of step SI10 is "YES", indicating that the flag PLAY is reset at "0", then the processing proceeds to step SI11.

In step SI11, the CPU 1 executes the play switch process which is activated when the play switch 9a is operated. FIGS. 17 and 18 show the contents of this routine in accordance with one embodiment of the present invention. In step SJ1 of this routine shown in FIG. 17, the flags PLAY, LPLAY, RPLAY are all set at "1". Then, the processing proceeds to step SJ2.

In step SJ2, the CPU 1 designates the head address of the header portion 6a of the song data (see FIG. 3) which corresponds to the song number stored in a song register SONG. This register SONG is designed to store the select number corresponding to one of the song select switches 9e (see FIG. 2) which is depressed by the performer in the song select switch process (see steps SI13, SI14). Then, the processing proceeds to step SJ3.

In step SJ3, the CPU reads out the data stored in the header portion 6a of the song data which is designated by the process of step SJ2, thereby setting several parameters and data. Then, the processing proceeds to step SJ4.

In step SJ4, the head address of the left-hand part 6b which is read out by the process of step SJ3 is written into the register LADRS, while the head address of the right-hand part 6c is written into the register RADRS. Then, the processing proceeds to step SJ5.

In the above process, the register LADRS stores the duration data which corresponds to the head address area of the left-hand part 6b of the song data. In step SJ5, this duration data is read from the register LADRS, and then the read duration data is written into the register LDUR which is described in the foregoing left-hand-part play process routine (see FIGS. 8, 9). After completing this process of step SJ5, the processing proceeds to step SJ6.

In the foregoing process of step SJ4, the register RADRS stores another duration data which corresponds to the head address area of the right-hand part 6c of the song data. In step SJ6, this duration data is read from the register RADRS, and then the read duration data is written into the register RDUR which is described in the foregoing right-hand-part play process routine (see FIGS. 10, 11). After completing this process of step SJ6, the processing proceeds to step SJ7 shown in FIG. 18.

In step SJ7, values of the registers LADRS, RADRS are respectively incremented by "1". Then, the processing proceeds to step SJ8.

In step SJ8, it is judged whether or not the flag LGUID, which is described in the foregoing left-guide switch process, is set at "1". If the judgement result is "NO", indicating that the flag LGUID is set at "0", then the processing step SJ9.

In step SJ9, value of the register RTIME, representing the tone-generation timing for the right-hand part, is set at "0". Then, the processing proceeds to step SJ11.

On the other hand, if the judgement result of step SJ8 is "YES", indicating that the flag LGUID is set at "1", the processing proceeds to step SJ10.

In step SJ10, the value "−96" is set to the register RTIME. Thus, the guide lamp 11b is turned on at the correct key-depression timing for the left-hand part, i.e., at the timing which is prior to the key-depression timing for the right-hand part by one quarter-note period. Then, the processing proceeds to step SJ11.

In step SJ11, it is judged whether or not the flag RGUID, which is described in the foregoing right-guide switch process (see steps SI6 to SI9 shown in FIG. 16), is set at "1". If the judgement result is "NO", indicating that the flag RGUID is reset at "0", then the processing proceeds to step SJ12.

In step SJ12, value of the register LTIME, representing the tone-generation timing for the left-hand part, is reset at "0". Then, the processing proceeds to step SJ14.

On the other hand, if the judgement result of step SJ11 is "YES", indicating that the flag RGUID is set at "1", the processing proceeds to step SJ13.

In step SJ13, the value "−96" is set to the register LTIME. Thus, the guide lamp 11b is turned on at the correct key-depression timing for the right-hand part, i.e., at the timing which is prior to the key-depression timing for the left-hand part by one quarter-note period. Then, the processing proceeds to step SJ14.

In step SJ14, value of the register TC, which stores the tempo clocks, is reset at "0". Then, after passing through the foregoing manually-operable-element process routine shown in FIG. 16, the processing returns back to the main routine shown in FIG. 4, wherein it proceeds to step SA5.

Meanwhile, if the judgement result of the foregoing step SI2 shown in FIG. 16 turns to "YES" with respect to the stop switch 9b, shown in FIG. 2, to be depressed on, the processing branches to step SI12.

In step SI12, all of the flags PLAY, LPLAY, RPLAY are reset at "0". Thereafter, the processing returns back to the main routine, wherein it proceeds to step SA5.

In step SI12, if the judgement result turns to "YES" with respect to the song select switch 9c, shown in FIG. 2, to be depressed on, then the processing branches to step SI13.

In step SI13, it is judged whether or not the flag PLAY is reset at "0". If the judgement result is "NO", indicating that the flag PLAY is set at "1", the processing returns back to the main routine, wherein it proceeds to step SA5. This prevents the present system from responding to the operation of the song select switch 9c during the automatic performance.

On the other hand, if the judgement result of step SI13 is "YES", indicating that the flag PLAY is reset at "0", the processing proceeds to step SI14.

In step SI14, the register SONG stores the select number of one of plural song select switches which is depressed on by the performer. Thereafter, the processing returns back to the main routine, wherein it proceeds to step SA5.

Further, if the judgement result of step SI2 turns to "YES" with respect to the other switches to be depressed on, the processing branches to step SI15.

In step SI15, the CPU 1 carries out the processes corresponding to the other switches to be operated. Thereafter, the processing returns back to the main routine shown in FIG. 4, wherein it proceeds to step SA5.

In step SA5 shown in FIG. 4, the CPU 1 clears the key-event buffers and the other on-event buffers for manually-operable elements which are set in the RAM 3. Then, the processing proceeds to step SA6.

In step SA6, the CPU 1 carries out the other processes, and then the processing thereof returns to the foregoing step SA2.

[C] Modifications

The above-mentioned embodiment of the present invention can be modified as follows.

(1) The present embodiment is designed such that the automatic performance data is stored in the automatic performance data ROM 5 in advance. However, configuration of the present invention is not limited to such embodiment. In short, it is possible to modify the present embodiment such that the automatic performance data are read out from the external memory unit, such as the external RAM, ROM or disk, for example.

(2) In one embodiment, keys corresponding to either one of the left-hand part and right-hand part are guided. Of course, it is possible to simultaneously guide the keys of both parts.

(3) The foregoing embodiment sets the wait time as the predetermined period of time corresponding to one-measure and three-beats to be passed after the correct key-depression timing. This wait time is not limited to such period of time, therefore, it is possible to set longer or shorter period of time as the wait time.

(4) In the foregoing embodiment, the key-depression timing of the key to be depressed is informed to the performer by turning the corresponding guide lamp 11*b* on. Instead, it is possible to inform the performer of the key-depression timing by changing the light-color of the guide lamp 11*b* or by flashing the light of the guide lamp 11*b*.

(5) In the foregoing embodiment, the guide lamp 11*b* is turned on prior to the correct key-depression timing by one-beat-period of time. Instead, it is possible to turn the guide lamp 11*b* on at the correct key-depression timing.

Lastly, this invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. A key-to-be-depressed designating apparatus, comprising:

a keyboard including a plurality of keys, a sound circuit including a plurality of channels, memory means for storing automatic performance data, the automatic performance data including a plurality of single event data portions, each single event data portion representing a musical tone and a key to be depressed which correspond to a particular part of the automatic performance, register means for storing the single event data portions, and having a plurality of memory channels corresponding to the plurality of channels in the sound circuit, read-out means for performing a read-out operation, the read-out operation including reading the automatic performance data stored in the memory means and sequentially assigning the musical tone and key corresponding to the single event data portion to a single idle memory channel within the register means, designating means for designating the key to be depressed in accordance with the single event data portion stored in the single idle memory channel, key-depression monitoring means for determining a musical tone corresponding to a depressed key, and for assigning the musical tone corresponding to the depressed key to one of the tone channels in the sound circuit, comparison means for comparing the musical tone corresponding to the single event data portion stored in the single idle memory channel to the musical tone corresponding to the depressed key, and control means for controlling the read-out means such that the read-out operation will be continued after the designated key should have been depressed until a predetermined period of time elapses, such that a depression of a non-designated key will be ignored, and such that the read-out operation will be terminated if the designated key is not depressed during the predetermined period.

2. A key-to-be-depressed designating apparatus as defined in claim 1, wherein the designating means comprises a plurality of lighting elements corresponding to the plurality of keys, and lighting control means for illuminating a lighting element corresponding to the designated key.

3. A key-to-be-depressed designating apparatus as defined in claim 1, wherein the predetermined period of time corresponds to a predetermined number of measures of the automatic performance.

4. A key-to-be-depressed designating apparatus as defined in claim 2, wherein the lighting elements comprise electric light emitting elements.

5. A key-to-be-depressed designating apparatus as defined in claim 2, wherein the lighting elements comprise electronic light emitting elements.

6. A key-to-be-depressed designating apparatus as defined in claim 1, wherein the predetermined period begins when a correct key depression occurs.

7. A key-to-be-depressed designating apparatus as defined in claim 1, wherein the designating means defines a designation manner, the designation manner changing at the end of the predetermined period.

8. A key-to-be-depressed designating apparatus as defined in claim 7, wherein the designation means changes the designation of the designated key.

9. A key-to-be-depressed designating apparatus, comprising:

a keyboard including a plurality of keys, memory means for storing automatic performance data, the automatic performance data including a plurality of single event data portions, each single event data portion representing a musical tone and a key to be depressed which correspond to a particular part of the automatic performance, register means for storing the single event data portions and including a plurality of channels, read-out means for performing a read-out operation, the read-out operation including reading the automatic performance data stored in the memory means and sequentially assigning musical tones corresponding to single event data portions to a single idle channel within the register means, designating means defining a designation manner for designating the key to be depressed in accordance with the single event data portion, key-depression monitoring means for determining a musical tone corresponding to a depressed key, comparison means for comparing the musical tone corresponding to the single event data portion to the musical tone corresponding to the depressed key, and control means for controlling the read-out means such that the read-out operation will be continued until a predetermined period of time subsequent to the designation of the designated key elapses, such that a depression of a non-designated key will be ignored, and such that the read-out operation will be terminated if the designated key is not depressed during the predetermined period, wherein the designation manner changes the designation of the designated key at the end of the predetermined period, and wherein the control means controls the read-out means such that a read-out operation which has been terminated will be re-started upon a depression of the designated key whose designation has been changed by the designation means.

10. A key-to-be-depressed designating apparatus as defined in claim 1, wherein the automatic performance data comprises a left-hand part representing the performance of a left hand and a right-hand part representing the performance of a right hand.

11. A key-to-be-depressed designating apparatus as defined in claim 10, further comprising selecting means for selecting one of the left and right hand parts to be designated by the designating means.

12. A key-to-be-depressed designating apparatus as defined in claim 11, further comprising musical tone generation means for generating a musical tone corresponding to the part which is not selected by the selecting means.

13. A key-to-be-depressed designating apparatus as defined in claim 1, wherein the designated key is designated at a period prior to when the key should have been depressed.

14. A key-to-be-depressed designating apparatus, comprising:

a keyboard including a plurality of keys, a sound circuit including a plurality of channels, memory means for storing automatic performance data, the automatic performance data including a plurality of single event data portions, each single event data portion representing a musical tone and a key to be depressed which correspond to a particular part of the automatic performance, register means for storing the single event data portions, and having a plurality of memory channels corresponding to the plurality of channels in the sound circuit, read-out means for performing a read-out operation, the read-out operation including reading the automatic performance data stored in the memory means and sequentially assigning the musical tone and key corresponding to the single event data portion to a single idle memory channel within the sound circuit, designating means for designating the key to be depressed in accordance with the single event data portion stored in the single idle memory channel, checking means for determining whether a key depressed by a user matches the key designated by the designating means, counting means for counting a number of counts between when the designated key should have been depressed and a depression of the designated key, count value detecting means for detecting when the number of counts measured by the counting means reaches a predetermined value, and control means for controlling the read-out means such that the read-out operation will be terminated if the count value reaches the predetermined value.

15. A key-to-be-depressed designating apparatus as defined in claim 14, wherein the predetermined value corresponds to a predetermined number of measures.

16. A key designating apparatus for an electronic musical instrument, the designating apparatus comprising:

a plurality of tone activation keys;

a sound circuit including a plurality of channels;

memory means for storing automatic performance data as a plurality of data parts, each one of the data parts including a plurality of single event data portions, each single event data portion representing a musical tone and a tone activation key to be activated which correspond to a particular part of each data part in the automatic performance;

a plurality of register means for storing the single event data portions, the plurality of register means corresponding to the plurality of parts, and each register means have a plurality of memory channels corresponding to the channels in the sound circuit;

read-out means for performing a read-out operation on the memory means, the read-out operation including reading the plurality of data parts at the same time, the read-out means assigning the tone and tone activation key corresponding to the single event data portion of each data part to a single idle memory channel within the corresponding register means;

designating means for designating the tone activation key to be depressed in accordance with the single event data portion of each data part stored in the corresponding single idle memory channel;

tone activation key monitoring means for determining a musical tone corresponding to an activated tone activation key:

comparison means for comparing the musical tone of the designated tone activation key in each of the plurality of single idle memory channels to the musical tone corresponding to the activated tone activation key; and control means for controlling the read-out means such that the read-out operation will be continued after the designated tone activation key should have been depressed until a predetermined period of time elapses, such that a depression of a non-designated tone activation key will be ignored, and such that the read out operation will be terminated if the designated tone activation key is not depressed during the predetermined period.

17. A key designating apparatus according to claim 16, wherein the plurality of data parts comprise a right hand and a left hand part.

18. A key designating apparatus for an electronic musical instrument, the designating apparatus comprising:

a plurality of tone activation keys;

memory means for storing automatic performance data as a plurality of data parts, each one of the data parts including a plurality of single event data portions, each single event data portion representing musical tone data and a tone activation key to be activated which correspond to a particular part of each data part in the automatic performance;

read-out means for performing a read-out operation on the memory means, the read-out operation including reading the single event data portion in each of the plurality of data parts at the same time;

designating means for designating the tone activation key to be depressed in accordance with the read-out single event data portion of particular data parts; and control means for controlling the read-out means such that the read-out operation will be continued after the designated tone activation key should have been depressed until a predetermined period of time elapses, such that a depression of a non-designated key will be ignored, and such that the read out operation will be terminated if the designated tone activation key is not depressed during the predetermined period.

19. A key designating apparatus according to claim 18, wherein the plurality of data parts comprise a right hand and a left hand part.

* * * * *